US005745931A

United States Patent [19]

Ball

[11] Patent Number: 5,745,931

[45] Date of Patent: May 5, 1998

[54] METHOD AND MEANS FOR COVERING THE FLANGE OF A WASTE WATER STRAINER

[75] Inventor: William T. Ball, Leawood, Kans.

[73] Assignee: WCM Industries, Inc., Colorado Springs, Colo.

[21] Appl. No.: 599,291

[22] Filed: Feb. 9, 1996

[51] Int. Cl.[6] ..... A47K 1/14

[52] U.S. Cl. ..... 4/286

[58] Field of Search ..... 4/286, 287, 580, 4/288–292; 241/41.013, 41.015, 41.016

[56] References Cited

U.S. PATENT DOCUMENTS

| | | | |
|---|---|---|---|
| 4,310,933 | 1/1982 | Stratman | 4/286 |
| 4,671,976 | 6/1987 | Vidal | 4/292 X |
| 5,265,281 | 11/1993 | McAlpine | 4/287 |
| 5,318,230 | 6/1994 | Ferguson et al. . | |
| 5,330,811 | 7/1994 | Buchalter . | |
| 5,418,983 | 5/1995 | Garguillo et al. | 4/287 |

*Primary Examiner*—Charles E. Phillips

*Attorney, Agent, or Firm*—Zarley, McKee, Thomte, Voorhees, & Sease

[57] ABSTRACT

A waste water insert has a cylindrical wall surrounding a vertical cylindrical bore. A horizontal flange extends outwardly from the upper end of the wall and has a lip formed on its outer periphery. The horizontal flange of the waste water insert is superimposed over the horizontal flange of a conventional waste water strainer located in a bathtub, sink or the like. The lip at the outer perimeter of the flange of the insert fits over the outer periphery of the horizontal flange of the waste water strainer to center the insert on the strainer. The cylindrical wall of the insert extends downwardly through the conventional cylindrical wall of the waste water strainer with the two walls being spaced from each other by virtue of the cylindrical wall of the insert having a smaller diameter than that of the strainer. A sealant material is placed between the horizontal flanges of the insert and the strainer and provides the sole means of attachment between the insert and the strainer.

8 Claims, 1 Drawing Sheet

METHOD AND MEANS FOR COVERING THE FLANGE OF A WASTE WATER STRAINER

BACKGROUND OF THE INVENTION

A strainer in the plumbing field is the threaded fitting in the bottom of a sink, bathtub, or the like through which waste water flows from the receptacle. Strainers usually have valves or the like which control the gravity flow of water therethrough. All of these valve assemblies are threadably mounted within a threaded aperture located in the strainer.

Existing strainers have a vertically disposed externally threaded sleeve which engage corresponding threads on a fitting adjacent a vertically disposed aperture in the bottom of the water receptacle. The upper end of the sleeve terminates in a circular horizontal flange which engages and is sealed to the bottom of the receptacle around the aperture in the bottom of the receptacle. A hub with a threaded bore and with radially extending spokes is often located in a horizontal plane in the bottom of the strainer to support various closure valves.

It is occasionally necessary to change the strainer of a given receptacle because the flange thereof has become tarnished, disfigured, or because the flange is incompatible esthetically with the owners sense of ornamentation. Removal of the strainer is often a difficult task, particularly when the strainer has been in place for a long time. Conventional tools are typically insufficient for use in removal of the strainer. Further, there is a possibility that the threads of the replacement strainer will not be compatible with the threads of the fitting or bushing associated with the aperture of the receptacle.

Some attempts have been made to place a substitute flange over the existing flange by providing structure whereby the substitute flange can be threadably secured to threaded bores of the strainer which originally threadably received the valve assembly of the strainer. This approach to the installation of a substitute flange is not satisfactory because variations of thread sizes in the original strainers are often incompatible with the thread sizes of the substituted flange adapter.

It is therefore a principal object of this invention to provide a method and means for covering the flange of an existing strainer without removing the existing strainer and without using mechanical contrivances to hold the substituted flange in place.

A further object of this invention is to provide a method and means for covering the flange of an existing strainer which will permit easy installation, and which will be well within the ability of those not being skilled in the plumbing art.

These and other objects will be apparent to those skilled in the art.

SUMMARY OF THE INVENTION

A waste water insert has a cylindrical wall surrounding a vertical cylindrical bore. A horizontal flange extends outwardly from the upper end of the wall and has a lip formed on its outer periphery.

The horizontal flange of the waste water insert is superimposed over the horizontal flange of a conventional waste water strainer located in a bathtub, sink or the like. The lip at the outer perimeter of the flange of the insert fits over the outer periphery of the horizontal flange of the waste water strainer to center the insert on the strainer. The cylindrical wall of the insert extends downwardly through the conventional cylindrical wall of the waste water strainer with the two walls being spaced from each other by virtue of the cylindrical wall of the insert having a smaller diameter than that of the strainer. A sealant material is placed between the horizontal flanges of the insert and the strainer and provides the sole means of attachment between the insert and the strainer.

DESCRIPTION OF THE PREFERRED EMBODIMENT

Figure 1:
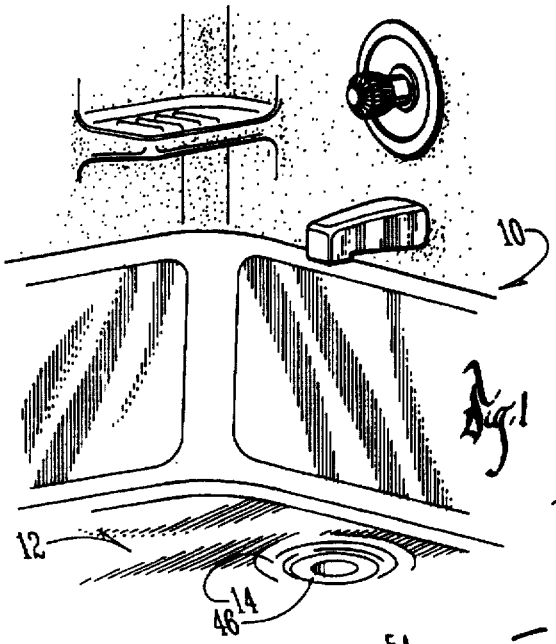
FIG. 1 is a partial perspective view of a conventional bathtub with a conventional waste water strainer located in the bottom thereof.
Figure 2:
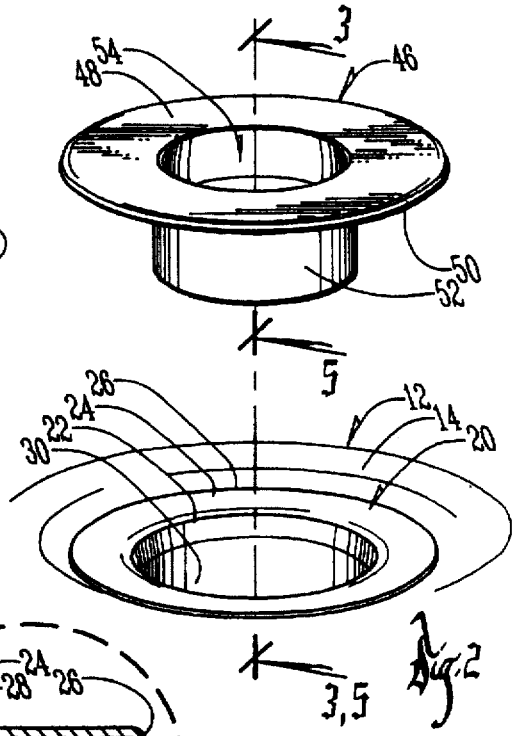
FIG. 2 is an exploded view showing a preliminary step in mounting the waste water insert onto the existing waste water strainer.

The numeral 10 designates a conventional fluid compartment or receptacle such as a tub or a sink. Compartment 10 has a bottom 12 with an interior bottom surface 14. A waste water aperture 16 (FIG. 4) is located in bottom 12 and a conventional shoulder 18 (FIGS. 3 and 4) surrounds the lower portion of the aperture 16.

Figure 5:
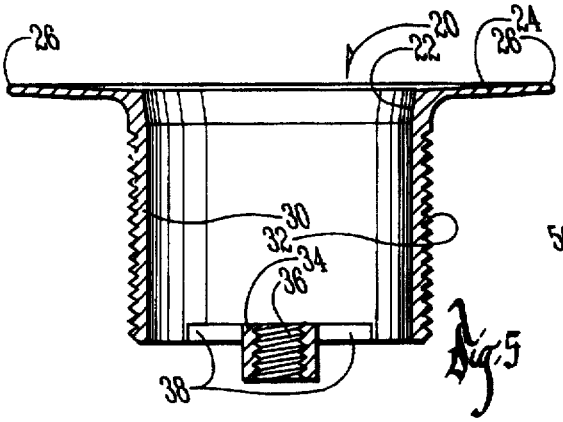
FIG. 5 is a sectional view of the existing waste water strainer taken on line 5—5 of FIG. 2.

A conventional waste water strainer 20 is shown in FIG. 5. Strainer 20 has an upper end 22 from which a horizontal circular flange 24 extends. The outer perimeter 26 of flange 24 engages the interior bottom surface 14 surrounding aperture 16. A sealant 28 (FIG. 4) seals the bottom of the flange 24 to the bottom 12 of the compartment 10. The strainer 20 has a downwardly extending cylindrical wall 30 (FIG. 5) and external threads 32. A center hub 34 having a vertically disposed threaded aperture 36 is located at the bottom of strainer 20. A plurality of radially extending arms 38 connect the center hub 34 with the interior bottom portion of cylindrical wall 30.

Figure 3:
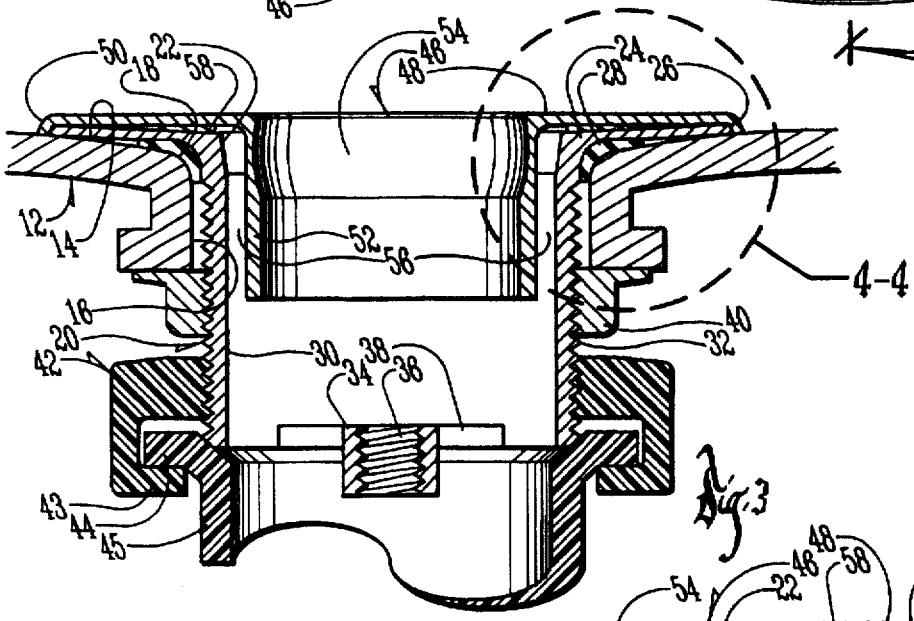
FIG. 3 is an enlarged scale sectional view taken on line 3—3 of FIG. 2 when the insert is assembled on the strainer.

With reference to FIG. 3, a first bushing 40 threadably engages external threads 32 on strainer 20. By tightening bushing 40 against the bottom of shoulder 18, the flange 24 of the strainer 20 is pulled into tight engagement with the bottom 12 of compartment 10. A second conventional bushing 42 (FIG. 3) is also threaded on the lower end of strainer 20. A depending flange 43 on bushing 42 grips depending flange 44 on waste water pipe 45 so that when bushing 42 is moved upwardly on the threads 32 of strainer 20, the flanges 43 and 44 will be drawn into tight engagement to secure the pipe 45 to the lower end of strainer 20.

The foregoing structure is conventional and does not of itself constitute the instant invention. The typical closure valves which may be associated with conventional strainer 20 have not been shown. They are typically threadably mounted in the threaded aperture 36 of center hub 34.

Figure 4:
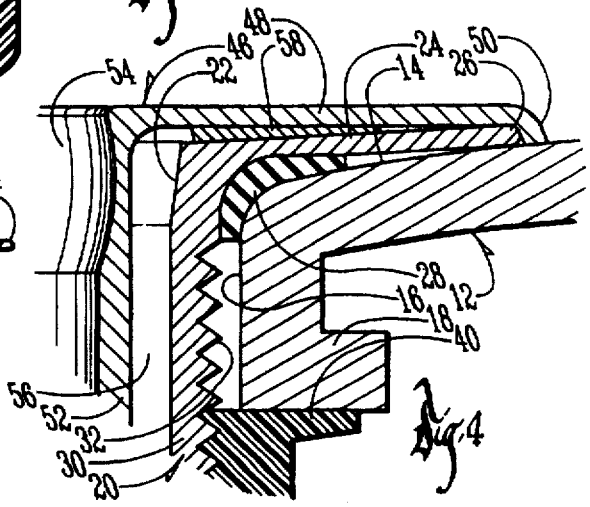
FIG. 4 is an enlarged scale sectional view taken on line 4—4 of FIG. 3.

The numeral 46 designates the waste water insert of this invention. Insert 46 has a horizontal flange 48 with the periphery thereof terminating in a downwardly extending lip 50. As best shown in FIGS. 3 and 4, the lip 50 extends downwardly and over the outer perimeter 26 of flange 24 of strainer 20. The lip 50 tightly engages the bottom 12 of compartment 10 when installed as will be discussed hereafter.

Insert 46 has a downwardly extending wall 52 which surrounds a center opening 54. The diameter of cylindrical wall 52 is less than the diameter of the cylindrical wall 30 of strainer 20 so that a space 56 (FIGS. 3 and 4) exist between the two walls. A conventional sealant material 58 (FIG. 4 is located between the horizontal flange 48 of insert 46 and the horizontal flange 24 of strainer 20. The sealant material 58 is the sole means of connection between the insert 46 and the strainer 20. The lip 50 on the outer perimeter of the flange 48 of insert 46 centers the cylindrical wall 52 within the cylindrical wall 30 of strainer 20 (FIG. 5).

If the horizontal flange 24 of strainer 20 becomes disfigured or discolored, or if the owner of the receptacle 10 desires to have the color of the flange 24 changed, it is not necessary through the instant invention to have the strainer 20 removed from the compartment 10. Rather, the existing closure valve, if any, associated with strainer 20 is removed from the strainer. The sealant material 58 is placed on the upper surface of the horizontal flange 24 of the strainer 20, and the insert 46 is thereupon superimposed over the horizontal flange 24 of the strainer as described above. The insert is held in place through the cooperation of the lip 50 which centers the insert over the strainer, and through the sealant 58 which retains the insert in tight engagement with the strainer. The strainer does not need to be removed from the compartment 10, and no special tools are required to mask the flange 24 with the flange 48 of insert 46.

Therefore, it is seen that this invention will accomplish at least all of its stated objectives.

What is claimed is:

1. In combination with a fluid compartment having a bottom with a waste water strainer mounted in said bottom, said strainer having a cylindrical wall surrounding a vertical cylindrical opening extending through the bottom of said compartment, and a horizontal flange extending outwardly from a level above and adjacent said cylindrical opening and positioned on the bottom of said compartment, a waste water insert comprising a cylindrical wall surrounding a vertical cylindrical bore and having an upper end, and a horizontal flange on said upper end extending outwardly from said cylindrical bore, the horizontal flange on said insert resting on the horizontal flange of said strainer with a sealant material therebetween, the horizontal flange on said insert being a flat planar surface uninterrupted by any vertical projections, the cylindrical wall of said insert being of a smaller diameter than the diameter of the cylindrical wall of said strainer to create a continuous space therebetween, and extends downwardly in spaced relation into the cylindrical opening of said strainer, the horizontal flange on said strainer having an outer peripheral edge, and a horizontal flange on said insert having an outer peripheral edge with a downwardly extending lip thereon extending over and being in tight engagement with the bottom of said fluid compartment and in engagement with the outer peripheral edge of said horizontal flange of said strainer, the cylindrical wall of said insert being free from engagement with the cylindrical wall of said strainer, and the sealant between the horizontal flanges of said strainer and said insert providing the sole means of fixed connection between said strainer and said insert.

2. The combination of claim 1 wherein the horizontal flange on said strainer has an outer peripheral edge, and the horizontal flange on said insert has an outer peripheral edge with a downwardly extending lip thereon extending over and being in engagement with the outer peripheral edge of said horizontal flange of said strainer so that the insert will be concentrically centered on said strainer.

3. The combination of claim 2 wherein the cylindrical wall on said insert is spaced and out of engagement with the cylindrical wall of said strainer.

4. The combination of claim 1 wherein the cylindrical wall on said insert is spaced and out of engagement with the cylindrical wall of said strainer.

5. The combination of claim 1 wherein said sealant is located in a layer between the horizontal flanges on said insert and said strainer in an area that does not extend to the lip on said insert.

6. The combination of claim 1 wherein said sealant is encapsulated between said horizontal flanges on said insert and said strainer and is hidden from view by the engagement of said lip on the horizontal flange of said insert with the bottom of said fluid compartment.

7. The combination of claim 1 wherein said sealant is encapsulated between said horizontal flanges on said insert and said strainer and is not in direct fluid communication with said fluid compartment.

8. In combination with a fluid compartment having a bottom with a waste water strainer mounted in said bottom, said strainer having a cylindrical wall surrounding a vertical cylindrical opening extending through the bottom of said compartment, and a horizontal flange extending outwardly from a level above and adjacent said cylindrical opening and positioned on the bottom of said compartment, a waste water insert comprising a cylindrical wall surrounding a vertical cylindrical bore and having an upper end, and a horizontal flange on said upper end extending outwardly from said cylindrical bore, the horizontal flange on said insert resting on the horizontal flange of said strainer, and the cylindrical wall of said insert being of a smaller diameter than the diameter of the cylindrical wall of said strainer and extending downwardly into the cylindrical opening of said strainer, the cylindrical wall of said insert being free from engagement with the cylindrical wall of said strainer to create a continuous space therebetween, the horizontal flange on said strainer having an outer peripheral edge, and the horizontal flange on said insert having an outer peripheral edge with a downwardly extending lip thereon extending over and being in tight engagement with said bottom and in engagement with the outer peripheral edge of said horizontal flange of said strainer so that the insert will be concentrically centered on said strainer only by the engagement of the lip with the outer peripheral edge of the strainer flange.

* * * * *